US005722275A

United States Patent [19]

Price et al.

[11] Patent Number: 5,722,275

[45] Date of Patent: Mar. 3, 1998

[54] PUSHBUTTON CONSOLE LATCH

[75] Inventors: Robert J. Price, Shorewood; John E. Bailen, West Allis, both of Wis.

[73] Assignee: Strattec Security Corporation, Milwaukee, Wis.

[21] Appl. No.: 647,029

[22] Filed: May 9, 1996

[51] Int. Cl.[6] ..... E05B 9/10

[52] U.S. Cl. ..... 70/379 R; 70/360

[58] Field of Search ..... 70/379 R, 360, 70/DIG. 42, 361, 370

[56] References Cited

U.S. PATENT DOCUMENTS

| | | | |
|---|---|---|---|
| 2,049,742 | 8/1936 | Jacobi | 70/379 R |
| 2,086,034 | 7/1937 | Jacobi | 70/144 |
| 2,087,031 | 8/1937 | Craig | 70/264 |
| 2,221,095 | 11/1940 | Jacobi | 70/84 |
| 2,313,711 | 3/1943 | Jacobi | 70/145 |
| 2,313,712 | 3/1943 | Jacobi | 70/451 |
| 2,322,892 | 6/1943 | Springer | 70/149 |
| 2,437,299 | 3/1948 | Jacobi | 70/81 |
| 2,483,365 | 9/1949 | Feldmann | 70/360 |
| 2,573,061 | 10/1951 | Raymond | 70/81 |
| 2,660,046 | 11/1953 | Jacobi | 70/344 |
| 2,683,978 | 7/1954 | Jacobi | 70/360 |
| 2,724,956 | 11/1955 | Psik | 70/181 |
| 2,726,889 | 12/1955 | Lawson | 292/170 |
| 3,910,082 | 10/1975 | Patriquin | 70/360 |
| 3,919,866 | 11/1975 | Lipschutz | 70/81 |
| 4,083,589 | 4/1978 | Palmerino | 292/336.3 |
| 4,956,983 | 9/1990 | Okamura et al. | 70/241 |
| 5,186,031 | 2/1993 | Janssen et al. | 70/227 |
| 5,263,348 | 11/1993 | Wittwer | 70/379 R |

*Primary Examiner*—Steven N. Meyers
*Assistant Examiner*—Tuyet-Phuong Pham
*Attorney, Agent, or Firm*—Reinhart, Boerner, Van Deuren, Norris & Rieselbach, s.c.

[57] ABSTRACT

A pushbutton console latch is provided. The latch includes a cylindrical housing for housing a pushbutton therein. The pushbutton incorporates a lost motion feature such that when a pushbutton is in the locked position and depressed, the bolt of the latch remains extended. However, when the pushbutton is rotated to an unlocked position, a pushbutton may be depressed thereby retracting the bolt.

9 Claims, 4 Drawing Sheets

PUSHBUTTON CONSOLE LATCH

BACKGROUND AND SUMMARY OF THE INVENTION

This invention relates to latches, and more particularly, to a pushbutton console latch incorporating a lost motion feature.

Pushbutton latches are used in a wide variety of applications to control unlimited number of elements and/or mechanisms. In the motor vehicle industry, pushbuttons are often used to unlatch compartments within the vehicle such as a glove compartment or the like. In addition, it is often times desirable to limit access to the interior of a compartment. This may be accomplished by incorporating a cylinder lock into the pushbutton latch which prevents the depression of the pushbutton without a mated key and as such, prevents retraction of the bolt. Hence, when a pushbutton is in its locked position, the cylinder lock incorporated therein maintains the pushbutton in its extended position.

Due to increased safety concerns, automobile manufacturers now discourage incorporating rigid or fixed projections which extend into the passenger compartment of the vehicle. During an accident or sudden stop, any passengers within the passenger compartment may engage the projection causing injury. Hence, it is highly desirable to provide a pushbutton console latch wherein the pushbutton may be depressed when the cylinder lock is in the locked position.

Therefore, it is a primary object and feature of the present invention to provide a pushbutton console latch wherein the pushbutton may be depressed with the latch in either the locked or the unlocked position.

It is a further object and feature of the invention to provide a pushbutton control latch which incorporates a lost motion feature.

It is a further object and feature of the present invention to provide a pushbutton console latch which is easy to operate, and yet may be used to deny access to a compartment in a vehicle.

In accordance with the present invention, a pushbutton console latch is provided. The pushbutton console latch includes a cylindrical housing extending along a longitudinal axis, an external cylindrical surface, and an internal peripheral surface defining the pushbutton receipt cavity in the cylindrical housing.

The pushbutton console latch further includes a pushbutton rotatably and slidably received within the pushbutton receipt cavity of the cylindrical housing. The pushbutton is rotatable between a first unlocked position and a second locked position, and is also axially slidable in the housing between a first extended position and a second depressed position. Means are provided for biasing the pushbutton toward the extended position.

A bolt is slidably mounted in a bolt ward contained in the cylindrical housing. The bolt ward, and therefore the bolt, are orientated transversely in a plane passing perpendicularly through the longitudinal axis. With the pushbutton in the unlocked position, the bolt slides radially into the bolt ward in response to the depression of the pushbutton from the extended position to the depressed position. However, when the pushbutton is in the locked position, the bolt remains extended in response to the depression of the pushbutton from the extended position to the depressed position.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE PREFERRED EMBODIMENT

Figures 1, 2, 3:
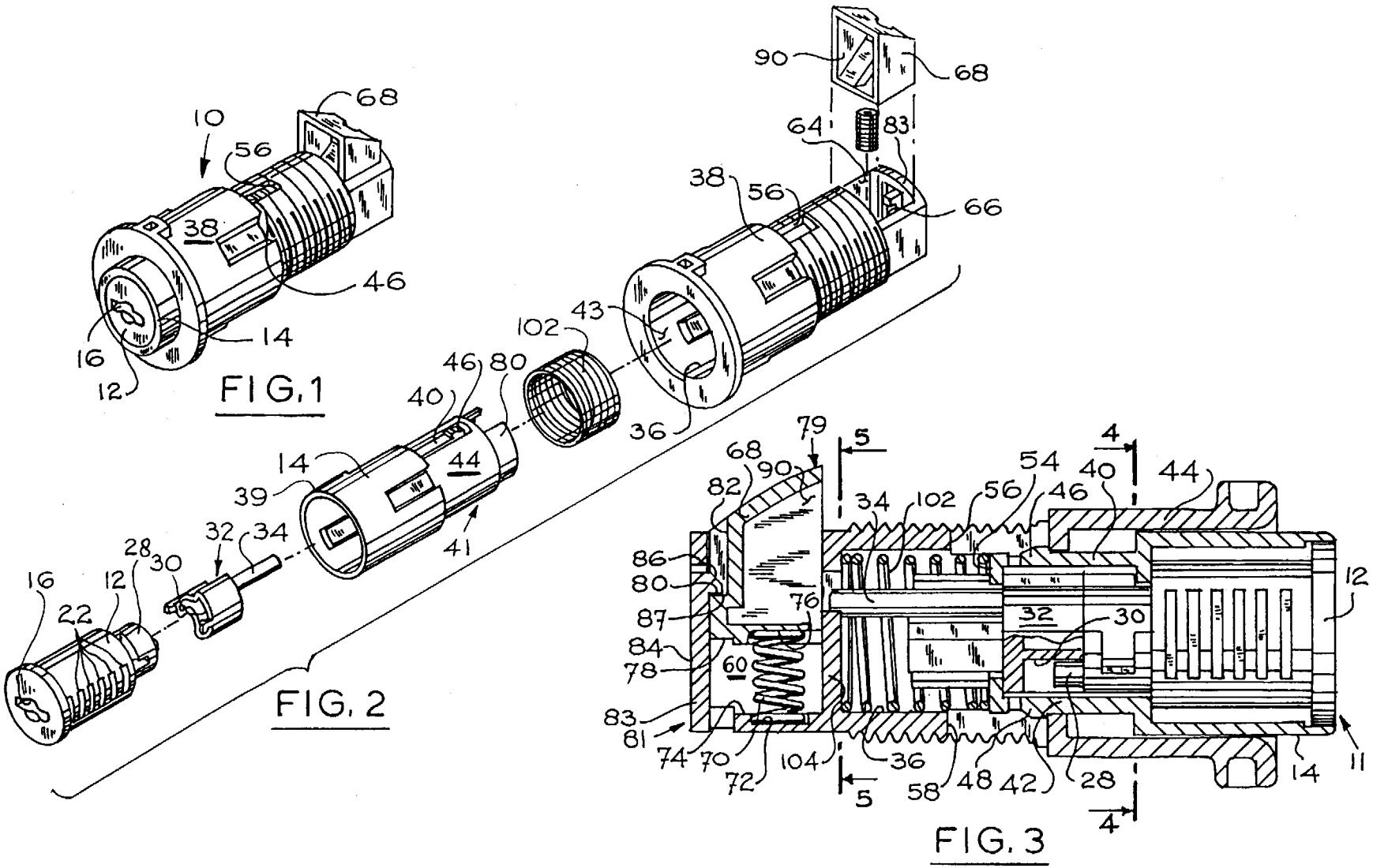
FIG. 1 is an isometric view of a pushbutton console latch in accordance with the present invention.
FIG. 2 is an exploded, isometric view of a locked pushbutton console latch of FIG. 1.
FIG. 3 is a cross-sectional view of a locked pushbutton control latch in accordance with the present invention showing a pushbutton in its extended position.

Referring to FIG. 1, a pushbutton console latch of the present invention is generally designated by the reference numeral 10. Console latch 10 includes a pushbutton assembly 11 compressed of a pushbutton 12 extending along the longitudinal axis and which is rotatably supported within a sleeve 14.

Pushbutton 12 is in the form of a cylindrical, substantially hollow housing, which defines a central longitudinal axis about which pushbutton 12 is rotated. Pushbutton 12 includes a center keyway 16 disposed along the longitudinal axis for receiving a key (not shown) in a conventional manner to permit rotation of pushbutton 12. As is conventional, keyway 16 opens at its front end to the front face of pushbutton 12 and is blind or closed at the opposite end of pushbutton 12.

Pushbutton 12 is rotatable in sleeve 14 between a first locked position and a second fully rotated position. When a mated key is not present in the pushbutton 12, pushbutton 12 cannot be rotated. However, when a mated key is inserted in the keyway 16 of pushbutton 12, the key in the pushbutton may be rotated between the locked position and a fully rotated position in a known manner.

A plurality of tumblers (not shown) are slidably mounted within a corresponding number of tumbler slots or wards 22 contained within pushbutton 12. Each ward 22, and therefore the tumblers (not shown), are orientated transversely in a plane passing perpendicularly through the longitudinal axis. As is known, each ward or slot 22 is defined by opposing walls in pushbutton 12 which guide the tumblers in their sliding movement.

Figure 4:
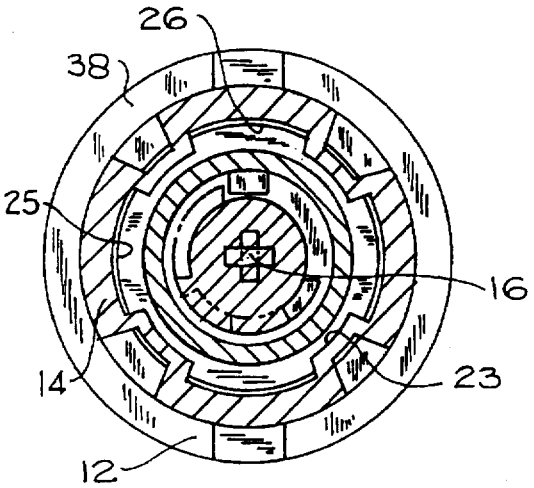
FIG. 4 is a cross-sectional view of the locked pushbutton control latch of FIG. 3 taken along line 4—4.

When a mated key is not present in the keyway 16 of pushbutton 12 and the pushbutton is in the first position, each tumbler projects from the outer cylindrical surface 24 of pushbutton 12 into a recessed channel 25 along the inner peripheral surface 23 of sleeve 14 so as to prevent rotation of pushbutton 12 with respect to sleeve 14. Similarly, when the mated key is not present in the keyway 16 of pushbutton 12 and the pushbutton is in the second fully rotated position, each tumbler projects from the outer cylindrical surface 24 of pushbutton 12 into a second recessed channel 26, FIG. 4, along the inner peripheral surface of sleeve 14 so as to prevent rotation of pushbutton 12 with respect to sleeve 14.

Pushbutton 12 further includes a driver 28 extending laterally from the closed end of pushbutton 12. Driver 28 is adapted for receipt within a driver receipt cavity 30 formed in a first end 32 of plunger member 34. It is contemplated as being within the scope of the present invention to form driven 28 and plunger member 34 integrally.

Sleeve 14 is in the form of a generally cylindrical, substantially hollow tube adapted for slidable receipt within a pushbutton cavity 36 in housing 38. Sleeve 14 has a forward end 39 and a rearward end 41, and includes a cylindrical outer surface 44 and a cylindrical inner surface 43 which defines a passageway through sleeve 14 for receiving the elongated, rotatable pushbutton 12 therein. Cylindrical outer surface 44 forms an axially sliding interface with the cylindrical inner surface 43 of housing 38.

Sleeve 14 includes a pair of projections and 42 which extend axially along the cylindrical outer surface 44 of sleeve 14. Each projection 40 and 42 terminates at a corresponding tab members 46 and 48, respectively, which project radially from the cylindrical outer surface 44 of sleeve 14. Projections 40 and 42 are constructed from a resilient material such that tab members 46 and 48 may be urged radially inwardly against the bias of projections 40 and 42, respectively, below the cylindrical outer surface 44 of sleeve 14.

An arcuate flange 50 extends axially from rearward end 41 of sleeve 14. Flange 50 and rearward end 41 intersect to form a spring engaging shoulder 54 on sleeve 14.

Housing 38 extends along the longitudinal axis and includes circumferentially spaced, first and second tab member receiving guide slots 56 and 58 which are adapted for receiving tab members 46 and 48, respectively, therein in order guide the axial movement of sleeve 14 therein. Housing 38 further includes a radially extending bolt receipt cavity 60 therein. Bolt receipt cavity 60 communicates with pushbutton cavity 36 in housing 38 through passageway 62.

A bolt 68 is slidably mounted within bolt receipt cavity 60 contained within housing 38. Bolt receipt cavity 60, and therefore bolt 68, is oriented transversely in a plane passing perpendicularly through the longitudinal axis. As best seen in FIG. 2, bolt receipt cavity 60 is defined by opposing walls 64 and 66 in housing 38 which guide bolt 68 and its sliding movement.

Bolt 68 also includes a corresponding coil spring 70 extending between a recessed channel 72 formed along radially inner surface 74 of housing 38 and a boss 76 formed in underside 78 of bolt 68. Thus, bolt 68 is continuously urged into an extended position by coil spring 70 such that the radial outer end 79 of bolt 60 projects from the cylindrical outer surface 81 of housing 38. Pushbutton cavity 36 opens at the front face of housing 38 and is blind or closed at the opposite end 81 of housing 38.

Closed end 81 terminates at a sidewall 83 which is oriented transversely in a plane passing perpendicularly through the longitudinal axis, and which interconnects opposing wall 64 and 66 in housing 38 which guides bolt 68 and its sliding movement. Sidewall 83 includes an inner surface 85 directed toward the interior of housing 38. Inner surface 85 forms a sliding inner face with rearward surface 82 of bolt 68. Sidewall 81 includes a projection 84 which extends in the direction perpendicular to the longitudinal axis. Projection 84 terminates at a tab member 86 which projects into the bolt receipt cavity 60 within housing 38. Projection 84 is constructed from a resilient material such that tab member 86 may be urged from bolt receipt cavity 60 against the bias of projection 84.

A shoulder 80 is formed in the rearward surface 82 of bolt 68. As bolt 68 is biased radially by spring 70, shoulder 80 engages the underside 87 of tab member 86 which extends into bolt receipt cavity 60 in housing 38. As such, tab member 86 retains bolt 68 partially within bolt receipt cavity 60 in housing 38, and provides a limit for the radial movement of bolt 68 under the bias of spring 70.

Figure 5:
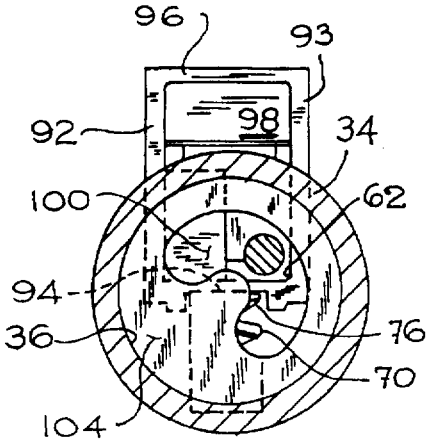
FIG. 5 is a cross-sectional view of the locked pushbutton control latch of FIG. 3 taken along line 5—5.
Figure 8:
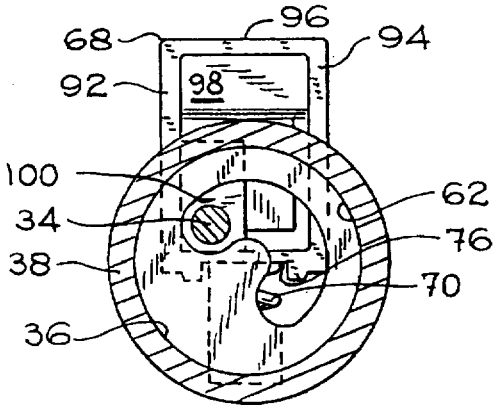
FIG. 8 is a cross-sectional view of the pushbutton control latch of FIG. 7 taken along line 8—8.

As best seen in FIGS. 2, 5 and 8, bolt 68 includes an internal cavity 90. Internal cavity 90 is defined by first 92 and second 93 parallely extending sidewalls interconnected by upper 96, lower 94, and rearward 98 sidewalls. A ramp 100 extends from lower sidewall 94, toward upper sidewall 96, and intersects rearward sidewall 98. Ramp 100 is laterally spaced from sidewall 94, as best seen in FIG. 5.

Pushbutton console latch 10 is assembled such that sleeve 14 is retained in the housing 38 by tab members 46 and 48 of projections 40 and 42, respectively, which extend into guide slots 56 and 58, respectively. As such, pushbutton assembly 11 is axially slidable along the longitudinal axis between a first extended position, as shown in FIGS. 3 and 7, and a retracted position shown in FIGS. 6 and 9. Axial sliding of pushbutton assembly 11 with respect to housing 38 is guided by tab members 46 and 48 sliding along guide slots 56 and 58, respectively. A coil spring 102 is positioned about the arcuate flange 50 extending from the rearward end of sleeve 14, and extends between wall 104 in pushbutton receipt cavity 36 of housing 38 and spring engaging shoulder 54 on sleeve 14 such that coil spring 102 urges pushbutton assembly 11 into its extended position.

When pushbutton assembly 11 is retained within housing 38, plunger 34 is axially aligned with arcuate passageway 62 in wall 104 of housing 38.

Figure 6:
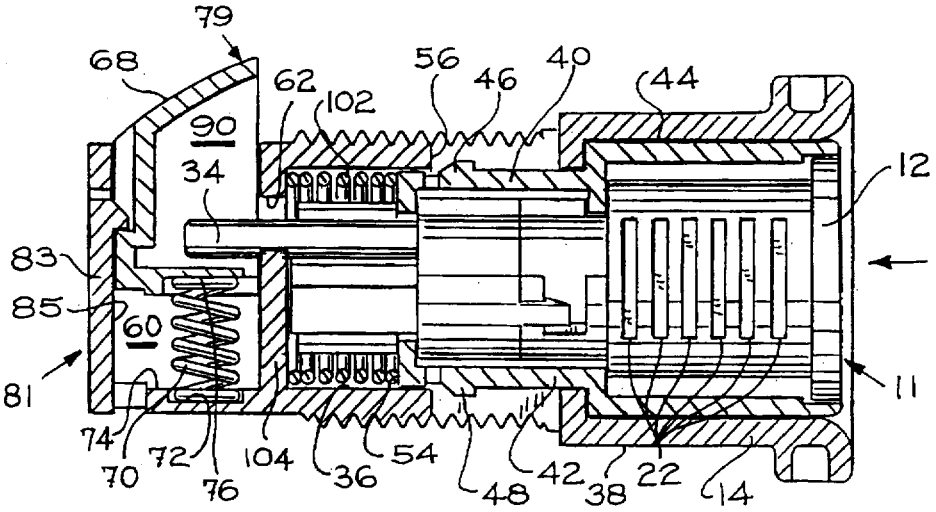
FIG. 6 is a cross-sectional view, similar to FIG. 3, showing the locked pushbutton control latch of the present invention, with the pushbutton in its retracted position.
Figure 7:
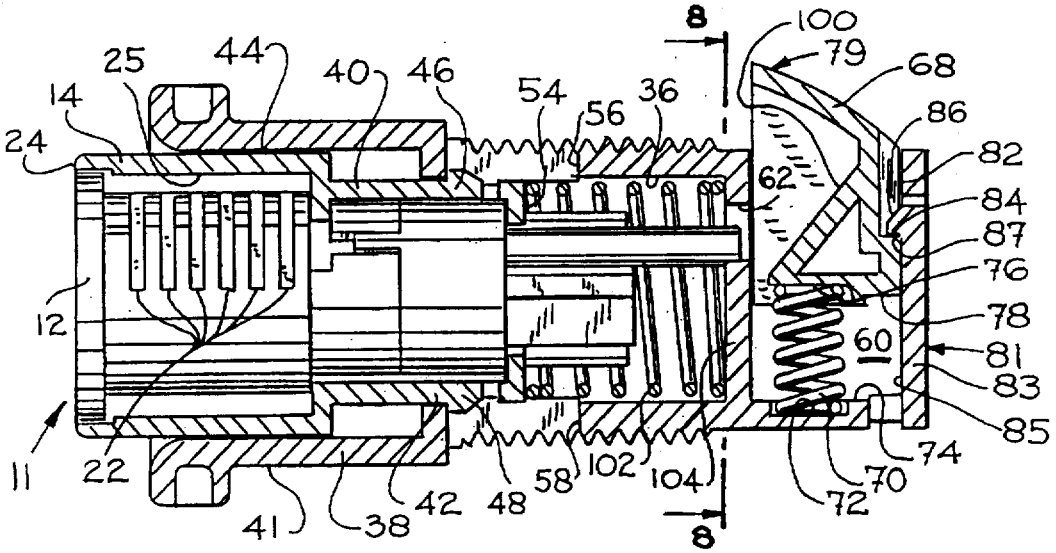
FIG. 7 is a cross-sectional view of an unlocked pushbutton control latch in accordance with the presentation showing the pushbutton in its extended position.

As best seen in FIGS. 3–6, when pushbutton 12 is rotated in sleeve 14 to the first locked position, pushbutton assembly 11 is movable between a first extended position, FIG. 3, and a second retracted position, FIG. 6. As seen in FIG. 5, plunger 34 is in axial alignment with internal cavity 90 of bolt 68 such that, when pushbutton assembly 11 is depressed to the second depressed position, FIG. 6, plunger 36 enters internal cavity 90 in bolt 68. As best seen in FIG. 6, with pushbutton assembly 11 depressed into housing 38, bolt 68 remains in its extended position.

Figure 9:
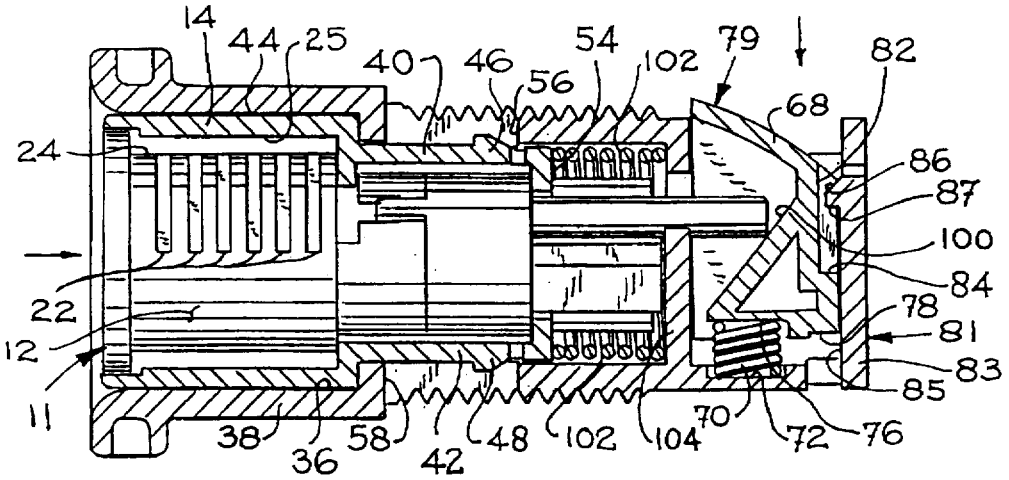
FIG. 9 is a cross-sectional view, similar to FIG. 7, showing the unlocked pushbutton control latch of the present invention with the pushbutton in its retracted position.
Figure 10:
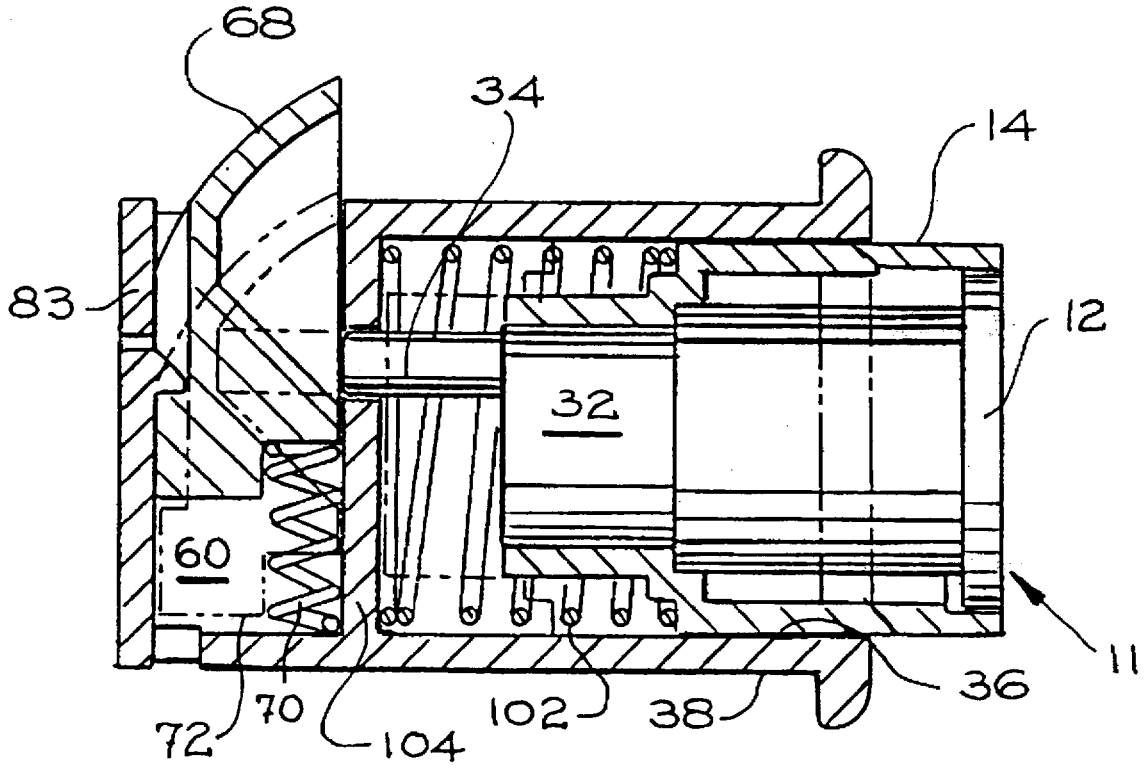
FIG. 10 is a cross-sectional view of an unlocked pushbutton control latch in accordance with the present invention showing the pushbutton and the bolt in their extending position, and showing in phantom the same in their retracted position.

Referring to FIGS. 7–9, when a mated key is present in keyway 16 of pushbutton 12, pushbutton 12 may be rotated to the unlocked position. With pushbutton 12 in the unlocked position, pushbutton assembly 11 may be depressed between a first extended position, FIG. 7, and a second depressed position, FIG. 9. As best seen in FIG. 8, with pushbutton 12 in the unlocked position, plunger 34 is axially aligned with ramp 100 formed in the internal cavity 90 of bolt 68. As pushbutton assembly 11 is depressed, plunger 34 engages ramp 100 so as to urge bolt 68 against the bias of spring 70 thereby retracting bolt 68 within bolt receipt cavity 60 contained within housing 38.

As pushbutton assembly 11 is released, coil spring 102 urges pushbutton assembly 11 back to its extended position, FIG. 7. In addition, as pushbutton assembly 11 returns to its extended position, coil spring 70 urges bolt 68 back to its extended position, FIG. 7.

It is contemplated that with pushbutton assembly 11 in its extended position, FIGS. 3 and 7, bolt assembly 68 may be urged into bolt receipt cavity 60 in housing 38 by a force on radially outer end 79 of bolt 60. For example, if pushbutton console latch 10 is used in conjunction with a glove compartment door, the glove compartment door may be closed with the pushbutton assembly 11 in the extended position. The striker element may engage the outer end 79 of bolt 60 thereby urging the bolt 68 into the bolt receipt cavity 60 against the bias of spring 70 and hence, allowing bolt 68 to pass the striker element. Once past the striker element, coil spring 70 urges bolt 68 back into its extended position.

Various modes of carrying out the invention are contemplated as being within the scope of the following claims particularly pointing out and distinctly claiming the subject matter which is regarded as the invention.

We claim:

1. A latch, comprising:

a cylindrical housing extending along a longitudinal axis and having an external cylindrical surface, and an inner peripheral surface defining a sleeve receipt cavity in the cylindrical housing, the cylindrical housing further including first and second circumferentially spaced guide slots extending axially along the inner peripheral surface, and a bolt ward orientated in a plane passing perpendicularly through the longitudinal axis, the bolt ward communicating with the sleeve receipt cavity in the cylindrical housing;

a sleeve slidably received within the housing, the sleeve slidable between a first extended position and a second depressed position, and defining an external cylindrical surface which forms a slidable interface with the inner peripheral surface of a cylindrical housing;

means for biasing a sleeve toward the first extended position;

first and second resilient projections which extend axially along the external cylindrical surface of the sleeve, each projection terminating at a corresponding tab adapted for slidable receipt in the guide slots, each tab movable between a first retracted position wherein the tab is retracted below the external cylindrical surface of the sleeve and a second extended position wherein the tab extends radially from the external cylindrical surface of the sleeve into a corresponding guide slot in the cylindrical housing;

a cylinder rotatably supported within the sleeve, the cylinder rotatable between a first unlocked position and a second locked position; and a bolt slidably received within the bolt ward, the bolt movable between a first extended position and a second retracted position.

2. The latch of claim 1 further comprising a plunger extending from the cylinder toward the bolt ward, the plunger movable between a first position wherein the plunger lies along a first axis parallel to the longitudinal axis and a second position wherein the plunger lies along a second axis parallel to the longitudinal axis and the first axis in response to rotation of the cylinder between the first unlocked position and the second locked position.

3. The latch of claim 2 wherein the bolt includes a cavity therein, the cavity partially defined by a bolt retraction surface such that when the cylinder is in the locked position and the sleeve is depressed to the press position, the plunger enters the bolt cavity and the bolt remains in the extended position, and such that when the cylinder is in the unlocked position and the sleeve is depressed to the second depressed position, the plunger engages bolt retraction surface and urges the bolt into its retracted position within the bolt ward.

4. The latch of claim 3 wherein the bolt includes a vertical wall in a plane perpendicular to the longitudinal axis and intersecting the bolt retraction surface, the vertical wall defining a portion of the bolt cavity which receives the plunger when the sleeve is in the depressed position and the cylinder is in the locked position.

5. The latch of claim 4 wherein the first axis extends through the bolt retraction surface, and the second axis extends through the portion of the bolt cavity which receives the plunger when the sleeve is in the depressed position.

6. The latch of claim 1 further comprising a means for biasing the bolt towards the first extended position.

7. A latch, comprising:

a cylindrical housing extending along a longitudinal axis and having an external cylindrical surface, and an inner peripheral surface defining a pushbutton receipt cavity in the cylindrical housing, the cylindrical housing including a bolt ward oriented in a plane passing perpendicularly through the longitudinal axis, the bolt ward communicating with the pushbutton receipt cavity in the cylindrical housing, and the cylindrical housing including first and second guide slots extending axially along the inner peripheral surface parallel to the longitudinal axis;

a pushbutton slidably received within the pushbutton receipt cavity, the pushbutton axially slidable between a first extended position and a second depressed position, and including a sleeve and a cylinder rotatably supported therein, the cylinder being coaxial with the cylindrical housing and rotatable between a first locked position and a second unlocked position, the sleeve of the pushbutton including first and second projections extending axially there along, each projection including a tab member receivable within a distinct, corresponding one of the guide slots in the cylindrical housing so as to guide the axial sliding of the pushbutton with respect to the housing;

a bias structure for biasing the pushbutton toward the extended position; and a bolt slidably received within the bolt ward, the bolt movable between a first extended position and a second retracted position, wherein the bolt is free to move to the retracted position when the cylinder is in the locked position.

8. The latch of claim 7 further comprising a further bias structure for biasing the bolt toward the first extended position.

9. The latch of claim 7 wherein the pushbutton includes a plunger extending axially toward the bolt ward.

* * * * *

UNITED STATES PATENT AND TRADEMARK OFFICE

CERTIFICATE OF CORRECTION

PATENT NO. : 5,722,275

DATED : Mar. 3, 1998

INVENTOR(S) : Price et al.

It is certified that error appears in the above-identified patent and that said Letters Patent is hereby corrected as shown below:

Col. 3, Line 28: insert -- 40 -- after "projections."

Signed and Sealed this

Fifteenth Day of September, 1998

*Attest:*

*Attesting Officer*

Bruce Lehman

BRUCE LEHMAN

*Commissioner of Patents and Trademarks*